US010502076B2

(12) United States Patent
Kuchana et al.

(10) Patent No.: US 10,502,076 B2
(45) Date of Patent: Dec. 10, 2019

(54) INTER-TURBINE DUCTS WITH FLOW CONTROL MECHANISMS

(71) Applicant: HONEYWELL INTERNATIONAL INC., Morris Plains, NJ (US)

(72) Inventors: Vinayender Kuchana, Andhra Pradesh (IN); Balamurugan Srinivasan, Karnataka (IN); Craig Mckeever, Gilbert, AZ (US); Malak Fouad Malak, Tempe, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 100 days.

(21) Appl. No.: 15/808,214

(22) Filed: Nov. 9, 2017

(65) Prior Publication Data

US 2019/0136702 A1 May 9, 2019

(51) Int. Cl.

| | |
|---|---|
| ***F01D 25/24*** | (2006.01) |
| ***F01D 9/04*** | (2006.01) |
| ***F01D 5/14*** | (2006.01) |
| *F01D 25/28* | (2006.01) |

(52) U.S. Cl.

CPC ..... *F01D 9/041* (2013.01); *F01D 5/145* (2013.01); *F01D 9/04* (2013.01); *F01D 25/28* (2013.01); *F05D 2220/32* (2013.01); *F05D 2240/12* (2013.01); *F05D 2240/124* (2013.01); *F05D 2240/127* (2013.01); *F05D 2250/13* (2013.01)

(58) Field of Classification Search

CPC ..... F04D 29/545; F04D 29/547; F01D 9/00; F01D 9/02; F01D 9/023

See application file for complete search history.

(56) References Cited

U.S. PATENT DOCUMENTS

| | | | | |
|---|---|---|---|---|
| 3,578,264 A | | 5/1971 | Kuethe | |
| 4,023,350 A | * | 5/1977 | Hovan | F01D 5/145 415/208.2 |
| 4,822,249 A | | 4/1989 | Eckardt et al. | |

(Continued)

FOREIGN PATENT DOCUMENTS

| | | | | |
|---|---|---|---|---|
| EP | 2554793 A2 | | 2/2013 | |
| EP | 3354848 A1 | | 8/2018 | |
| GB | 113273 A | * | 1/1919 | F01D 9/02 |

OTHER PUBLICATIONS

Haskew, J.T. and M.A.R. Sharif, "Performance Evaluation of Vaned Pipe Bends in Turbulent Flow of Liquid Propellants," Appl. Math. Modelling, vol. 21, Jan. 1997, p. 48-62.

(Continued)

*Primary Examiner* — Richard A Edgar

(74) *Attorney, Agent, or Firm* — Lorenz & Kopf, LLP

(57) ABSTRACT

A turbine section is provided for a gas turbine engine. The turbine section is annular about a longitudinal axis. The turbine section includes a first turbine with a first inlet and a first outlet; a second turbine with a second inlet and a second outlet; an inter-turbine duct extending from the first outlet to the second inlet and configured to direct an air flow from the first turbine to the second turbine, the inter-turbine duct being defined by a hub and a shroud; and at least a first splitter blade disposed within the inter-turbine duct. The first splitter blade includes a pressure side facing the shroud, a suction side facing the hub, and at least one vortex generating structure positioned on the suction side.

20 Claims, 5 Drawing Sheets

(56) References Cited

U.S. PATENT DOCUMENTS

| | | | | |
|---|---|---|---|---|
| 6,851,264 | B2 | 2/2005 | Kirtley et al. | |
| 7,137,245 | B2 | 11/2006 | Graziosi et al. | |
| 7,549,282 | B2 | 6/2009 | Widenhoefer et al. | |
| 7,931,720 | B2 | 4/2011 | Stucki | |
| 8,061,980 | B2 * | 11/2011 | Praisner | F01D 9/023 415/182.1 |
| 8,257,036 | B2 * | 9/2012 | Norris | F01D 25/30 415/208.2 |
| 8,517,686 | B2 | 8/2013 | Allen-Bradley et al. | |
| 8,845,286 | B2 | 9/2014 | Ramachandran et al. | |
| 2003/0192339 | A1 | 10/2003 | Macbain | |
| 2007/0012046 | A1 | 1/2007 | Larsson et al. | |
| 2013/0034433 | A1 | 2/2013 | Ramachandran et al. | |
| 2013/0192200 | A1 | 8/2013 | Kupratis et al. | |
| 2015/0030439 | A1 | 1/2015 | Pesteil et al. | |
| 2015/0300253 | A1 | 10/2015 | Lord | |
| 2016/0052621 | A1 | 2/2016 | Ireland et al. | |

OTHER PUBLICATIONS

Cuming, H.G., "The Secondary Flow in Curved Pipes," Aeronautical Research Council Reports and Memoranda No. 2880, Feb. 1952.

* cited by examiner

INTER-TURBINE DUCTS WITH FLOW CONTROL MECHANISMS

TECHNICAL FIELD

The present invention generally relates to gas turbine engines, and more particularly relates to inter-turbine ducts between the turbines of gas turbine engines.

BACKGROUND

A gas turbine engine may be used to power various types of vehicles and systems. A gas turbine engine may include, for example, five major sections: a fan section, a compressor section, a combustor section, a turbine section, and an exhaust nozzle section. The fan section induces air from the surrounding environment into the engine and accelerates a fraction of this air toward the compressor section. The remaining fraction of air induced into the fan section is accelerated through a bypass plenum and exhausted. The compressor section raises the pressure of the air it receives from the fan section and directs the compressed air into the combustor section where it is mixed with fuel and ignited. The high-energy combustion products then flow into and through the turbine section, thereby causing rotationally mounted turbine blades to rotate and generate energy. The air exiting the turbine section is exhausted from the engine through the exhaust section.

In some engines, the turbine section is implemented with one or more annular turbines, such as a high pressure turbine and a low pressure turbine. The high pressure turbine may be positioned upstream of the low pressure turbine and configured to drive a high pressure compressor, while the low pressure turbine is configured to drive a low pressure compressor and a fan. The high pressure and low pressure turbines have optimal operating speeds, and thus, optimal radial diameters that are different from one another. Because of this difference in radial size, an inter-turbine duct is arranged to fluidly couple the outlet of the high pressure turbine to inlet of the low pressure turbine and to transition between the changes in radius. It is advantageous from a weight and efficiency perspective to have a relatively short inter-turbine duct. However, decreasing the length of the inter-turbine duct increases the radial angle at which the air must flow between the turbines. Increasing the angle of the duct over a relatively short distance may result in boundary layer separation of the flow within the duct, which may adversely affect the performance of the low pressure turbine. Accordingly, the inter-turbine ducts are designed with a compromise between the overall size and issues with boundary separation. As a result, some conventional gas turbine engines may be designed with elongated inter-turbine ducts or inter-turbine ducts that do not achieve the optimal size ratio between the high pressure turbine and the low pressure turbine.

Accordingly, it is desirable to provide gas turbine engines with improved inter-turbine ducts. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a turbine section is provided for a gas turbine engine. The turbine section is annular about a longitudinal axis. The turbine section includes a first turbine with a first inlet and a first outlet; a second turbine with a second inlet and a second outlet; an inter-turbine duct extending from the first outlet to the second inlet and configured to direct an air flow from the first turbine to the second turbine, the inter-turbine duct being defined by a hub and a shroud; and at least a first splitter blade disposed within the inter-turbine duct. The first splitter blade includes a pressure side facing the shroud, a suction side facing the hub, and at least one vortex generating structure positioned on the suction side.

In accordance with another exemplary embodiment, an inter-turbine duct is provided and extends between a first turbine having a first radial diameter and a second turbine having a second radial diameter. The first radial diameter is less than the second radial diameter. The inter-turbine duct includes a hub; a shroud circumscribing the hub to form a flow path fluidly coupled to the first turbine and the second turbine; and at least a first splitter blade disposed within the inter-turbine duct. The first splitter blade includes a pressure side facing the shroud, a suction side facing the hub, and at least one vortex generating structure positioned on the suction side.

BRIEF DESCRIPTION OF THE DRAWINGS

The present invention will hereinafter be described in conjunction with the following drawing figures, wherein like numerals denote like elements, and FIG. 1 a schematic cross-sectional view of a gas turbine engine in accordance with an exemplary embodiment.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Broadly, exemplary embodiments discussed herein provide gas turbine engines with improved inter-turbine ducts. In one exemplary embodiment, the inter-turbine duct is positioned between a high pressure turbine with a relatively small radial diameter and a low pressure turbine with a relatively large radial diameter. The inter-turbine duct may be defined by a shroud forming an outer boundary and a hub forming an inner boundary. The inter-turbine duct may further include one or more splitter blades positioned at particular radial distances that prevent and/or mitigate boundary separation of the air flow from the shroud and other surfaces as the air flow transitions in a radial direction. Each splitter blade may include one or more vortex generating structures on the suction side to prevent and/or mitigate boundary separation of the air flow from the splitter blade. Improvements in boundary separation along the shroud and along the splitter blade enable shorter inter-turbine ducts, and as such, improvements in weight and efficiency.

Figure 1:
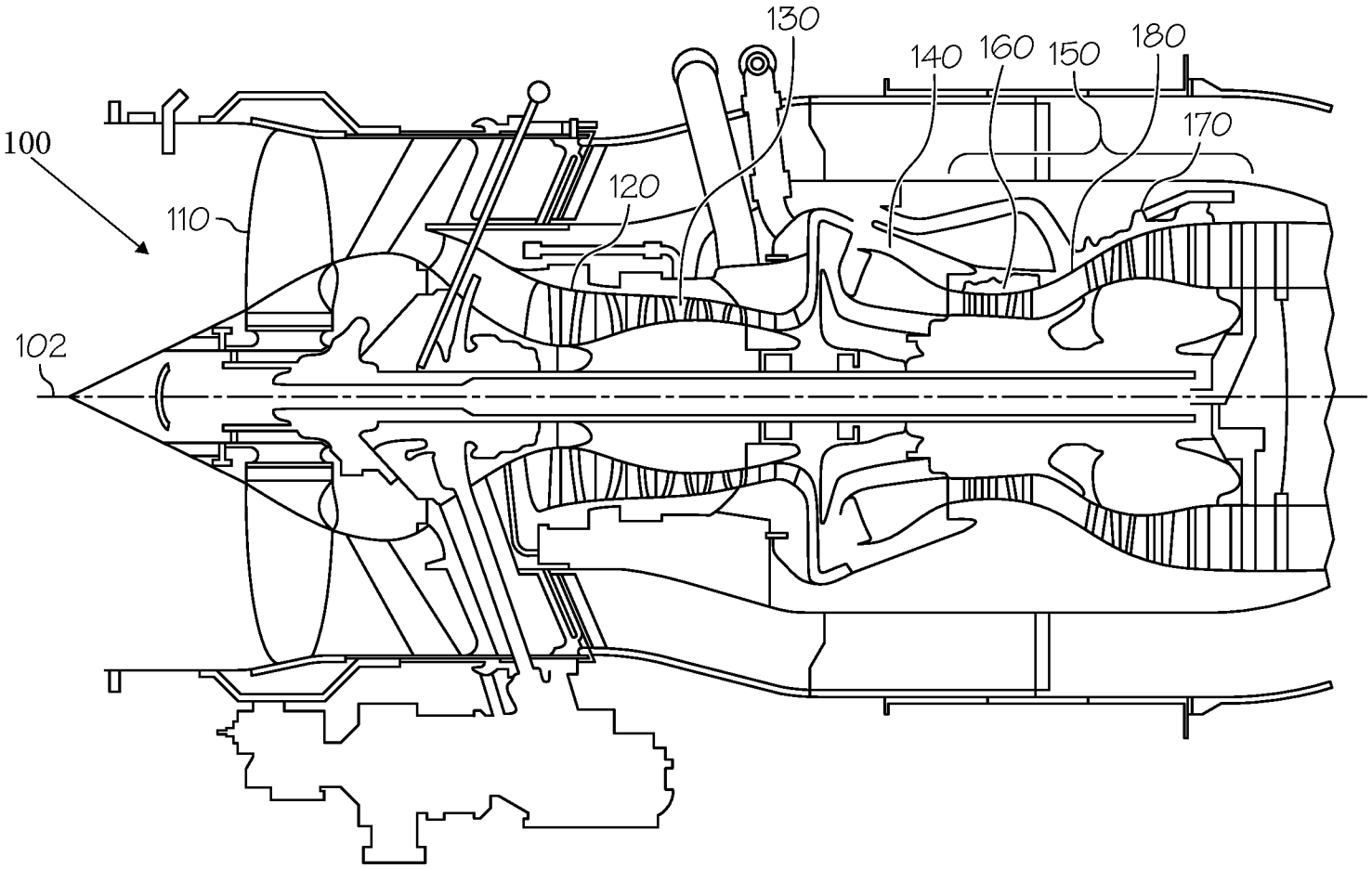

FIG. 1 a schematic cross-sectional view of a gas turbine engine 100 in accordance with an exemplary embodiment. As shown, the engine 100 may be an annular structure about a longitudinal or axial centerline axis 102. In the description that follows, the term "axial" refers broadly to a direction parallel to the axis 102 about which the rotating components of the engine 100 rotate. This axis 102 runs from the front of the engine 100 to the back of the engine 100. The term "radial" refers broadly to a direction that is perpendicular to the axis 102 and that points towards or away from the axis of the engine 100. A "circumferential" direction at a given point is a direction that is normal to the local radial direction and normal to the axial direction. As such, the term "axial-circumferential" plane generally refers to the plane formed by the axial and circumferential directions, and the term "axial-radial" plane generally refers to the plane formed by the axial and radial directions. An "upstream" direction refers to the direction from which the local flow is coming, while a "downstream" direction refers to the direction in which the local flow is traveling. In the most general sense, flow through the engine tends to be from front to back, so the "upstream direction" will generally refer to a forward direction, while a "downstream direction" will refer to a rearward direction.

The engine 100 generally includes, in serial flow communication, a fan section 110, a low pressure compressor 120, a high pressure compressor 130, a combustor 140, and a turbine section 150, which may include a high pressure turbine 160 and a low pressure turbine 170. During operation, ambient air enters the engine 100 at the fan section 110, which directs the air into the compressors 120 and 130. The compressors 120 and 130 provide compressed air to the combustor 140 in which the compressed air is mixed with fuel and ignited to generate hot combustion gases. The combustion gases pass through the high pressure turbine 160 and the low pressure turbine 170. As described in greater detail below, an inter-turbine duct 180 couples the high pressure turbine 160 to the low pressure turbine 170.

The high pressure turbine 160 and low pressure turbine 170 are used to provide thrust via the expulsion of the exhaust gases, to provide mechanical power by rotating a shaft connected to one of the turbines, or to provide a combination of thrust and mechanical power. As one example, the engine 100 is a multi-spool engine in which the high pressure turbine 160 drives the high pressure compressor 130 and the low pressure turbine 170 drives the low pressure compressor 120 and fan section 110.

Figure 2:
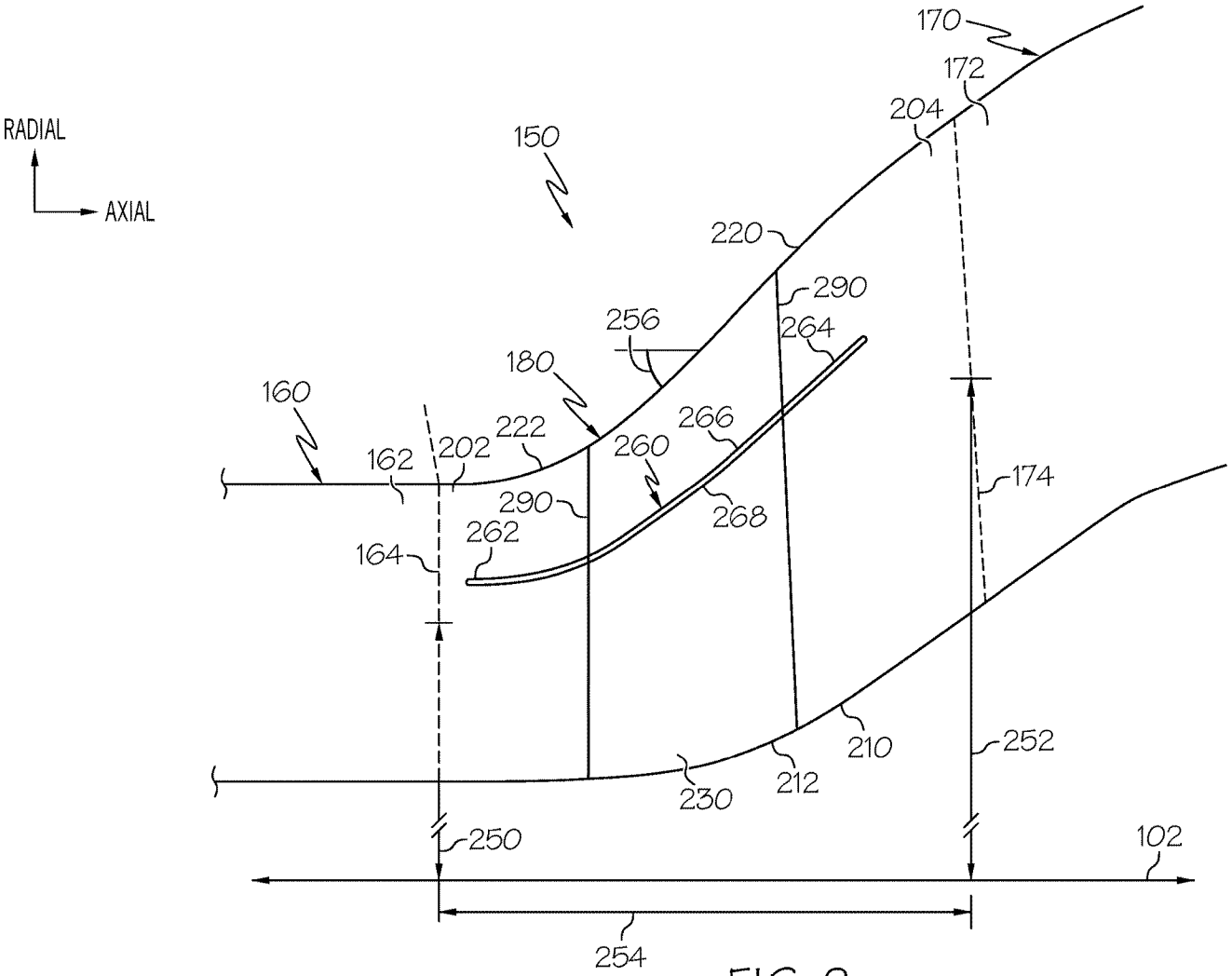
FIG. 2 is a schematic, partial cross-sectional view of a turbine section with an inter-turbine duct of the gas turbine engine of FIG. 1 in accordance with an exemplary embodiment.

FIG. 2 is a schematic, partial cross-sectional view of a turbine assembly with an inter-turbine duct, such as the inter-turbine duct 180 of the turbine section 150 of the engine 100 of FIG. 1 in accordance with an exemplary embodiment.

As shown, the turbine section 150 includes the high pressure turbine 160, the low pressure turbine 170, and the inter-turbine duct 180 fluidly coupling the high pressure turbine 160 to the low pressure turbine 170. Particularly, the inter-turbine duct 180 includes an inlet 202 coupled to the outlet 162 of the high pressure turbine 160 and an outlet 204 coupled to the inlet 172 of the low pressure turbine 170. In the depicted embodiment, the boundaries between the high pressure turbine 160 and the inter-turbine duct 180 and between the inter-turbine duct 180 and the low pressure turbine 170 are indicated by dashed lines 164, 174, respectively. The annular structure of the inter-turbine duct 180 is defined by a hub 210 and a shroud 220 to create a flow path 230 for air flow between the high pressure turbine 160 and low pressure turbine 170.

As noted above, the inter-turbine duct 180 transitions from a first radial diameter 250 at the inlet 202 (e.g., corresponding to the radial diameter at the outlet 162 of the high pressure turbine 160) to a larger, second radial diameter 252 (e.g., corresponding to the radial diameter at the inlet 172 of the low pressure turbine 170). In one exemplary embodiment, as shown in FIG. 2, the radial diameters are measured from the mid-point of the inter-turbine duct 180 although such diameters may also be measured from the hub 210 and/or the shroud 220. This transition is provided over an axial length 254. For example, the inlet 202 may be generally axial from the high pressure turbine 160, and at inflection points 212, 222, the hub 210 and shroud 220 extend at an angle 256 to the outlet 204. FIG. 2 illustrates the angle 256 as being generally straight and constant, but other shapes may be provided, including constantly changing or stepped changes in radial diameter. In one exemplary embodiment, the angle 256 may be 30° or larger.

In general, it is advantageous to minimize the axial length 254 of the inter-turbine duct 180 for weight and efficiency. For example, a shorter axial length 254 may reduce the overall axial length of the engine 100 (FIG. 1) as well as reducing friction losses of the air flow. However, as the axial length 254 is decreased, the corresponding angle 256 of the inter-turbine duct 180 between the radial diameters 250, 252 is increased.

During operation, the inter-turbine duct 180 functions to direct the air flow along the radial transition between turbines 160, 170. It is generally advantageous for the air flow to flow smoothly through the inter-turbine duct 180. Particularly, it is advantageous if the air flow adjacent to the shroud 220 maintains a path along the shroud 220 instead of undergoing a boundary layer separation. However, as the axial length 254 decreases and the angle 256 increases, the air flow along the shroud 220 tends to maintain an axial momentum through the inlet 202 and, if not addressed, attempts to separate from the shroud 220, particularly near or downstream the inflection point 222. Such separations may result in unwanted vortices or other turbulence that result in undesirable pressure losses through the inter-turbine duct 180 as well as inefficiencies in the low pressure turbine 170.

In one exemplary embodiment, one or more splitter blades 260 are provided within the inter-turbine duct 180 to prevent or mitigate the air flow separation. In some instances, the splitter blade 260 may be referred to as a splitters or guide vane. As described in greater detail below, one splitter blade 260 is illustrated in FIG. 2, and typically only one splitter blade 260 with the features described below is necessary to achieve desired results. However, in other embodiments, additional splitter blades may be provided.

The splitter blade 260 generally extends in an axial-circumferential plane, axi-symmetric about the axis 102 and has an upstream end 262 and a downstream end 264. In the depicted exemplary embodiment, the upstream end 262 of the splitter blade 260 is positioned at, or immediately proximate to, the inlet 202 of the inter-turbine duct 180, and the downstream end 264 of the splitter blade 260 are positioned at, or immediately proximate to, the outlet 204 of the inter-turbine duct 180. As such, in one exemplary embodiment, the splitter blade 260 extends along approximately the entire axial length 254 of the inter-turbine duct 180. Other embodiments may have different arrangements, including different lengths and/or different axial positions. For example, in some embodiments, the splitter blade may be relatively shorter than that depicted in FIG. 2 based on, in some cases, the length associated with a desired reduction of flow separation and minimization of loss, while avoiding unnecessary weight and cost.

The splitter blade 260 may be considered to have a pressure side 266 and a suction side 268. The pressure side 266 faces the shroud 220, and the suction side 268 faces the hub 210. Additional details about the suction side 268 of the splitter blade 260 are provided below. As also discussed below, the splitter blade 260 may have characteristics to prevent flow separation.

In accordance with exemplary embodiments, the splitter blade 260 may be radially positioned to advantageously prevent or mitigate flow separation. In one embodiment, the radial positions may be a function of the radial distance or span of the inter-turbine duct 180 between hub 210 and shroud 220. For example, if the overall span is considered 100% with the shroud 220 being 0% and the hub 210 being 100%, the splitter blade 260 may be positioned at approximately 33% (e.g., approximately a third of the distance between the shroud 220 and the hub 210), 50%, or other radial positions.

Figure 3:
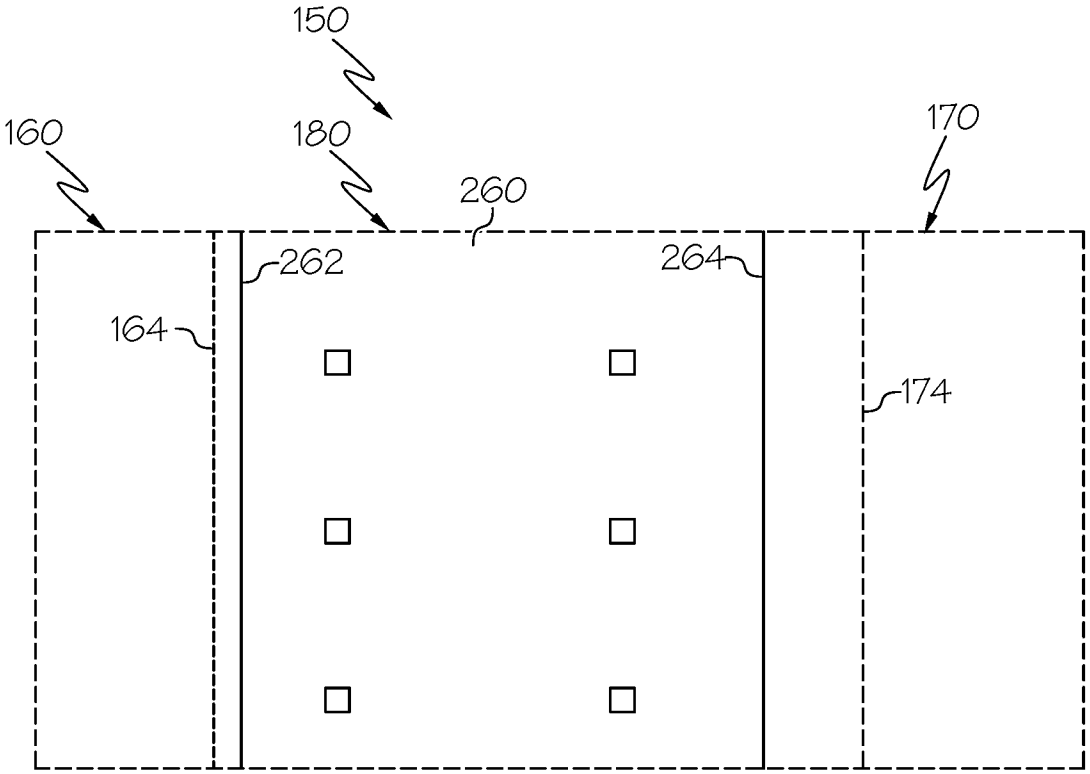
FIG. 3 is a schematic pressure side view of a splitter blade in the inter-turbine duct of FIG. 2 in accordance with an exemplary embodiment.

The splitter blade 260 may be supported in the inter-turbine duct 180 in various ways. In accordance with one embodiment, the splitter blade 260 may be supported by one or more struts 290 that extend generally in the radial direction to secure the splitter blades 260 to the shroud 220 and/or hub 210. In the depicted embodiment, one or more struts 290 extend from the shroud 220 to support the splitter blade 260. In one exemplary embodiment, the splitter blade 260 may be annular and continuous about the axis 102, although in other embodiments, the splitter blade 260 may be in sections or panels. Reference is briefly made to FIG. 3, which is a schematic pressure side (or top) view of the splitter blade 260 in the turbine section 150 of FIG. 2.

Returning to FIG. 2, the shape and size of the splitter blade 260 may be selected based on computational fluid dynamics (CFD) analysis of various flow rates through the inter-turbine duct 180 and/or weight, installation, cost or efficiency considerations. Although the splitter blade 260 generally extends in an axial-circumferential plane, the splitter blade 260 may also have a radial component. For example, in the embodiment shown in FIG. 2, the splitter blade 260 is generally parallel to the shroud 220, although other shapes and arrangements may be provided. For example, in other embodiments, the splitter blade 260 may be parallel to a positional or weighted mean line curve that is a function of the shroud 220 and hub 210. For example, for a particular % distance from the shroud 220 (e.g., 33%, 50%, etc.), the radial diameter along axial positions along a mean line curve may be defined by ((1−x%)(D_Shroud)+((x%)(D_Hub), thereby enabling a splitter blade 260 that is generally parallel to the selected mean line curve.

During operation, the splitter blade 260 prevents or mitigates flow separation by guiding the air flow towards the shroud 220 or otherwise confining the flow along the shroud 220. However, unless otherwise addressed, flow separation may occur on the splitter blade 260. As such, the splitter blade 260 may include one or more flow control mechanisms to prevent and/or mitigate flow separation as the air flows around the splitter blade 260, particularly flow separation on the suction side (or underside) 268 of the splitter blade 260.

Figure 4:
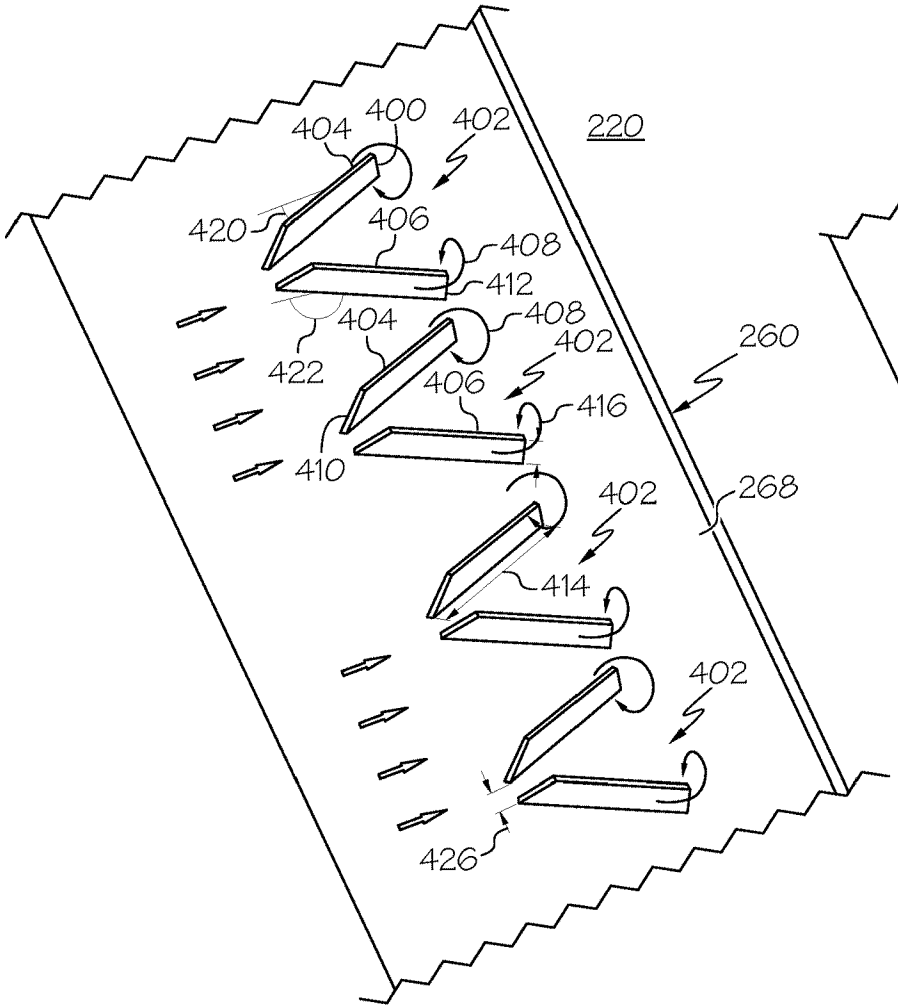
FIG. 4 is a schematic suction side view of the splitter blade in the inter-turbine duct of FIG. 2 in accordance with an exemplary embodiment.

Reference is made to FIG. 4, which is a schematic isometric suction side view of the splitter blade 260 of FIG. 2 in accordance with an exemplary embodiment. Relative to the view of FIG. 2, the view of FIG. 4 is from the underside of the splitter blade 260. Since the potential separation on the suction side 268 is small than the potential separation on the shroud 220, the turbulent micro-vortices generated by the vortex generating structures 400 sufficiently energize the boundary layer flow without additional components, e.g., without additional splitter blades. However, in some embodiments, multiple splitter blades may be provided with one or more of the blades having vortex generating structure 400 on the respective suction side.

As shown in FIG. 4, one or more vortex generating structures 400 are arranged on the suction side 268 of the splitter blade 260 as flow control mechanisms. The vortex generating structures 400 may be any structure that creates turbulent flow along the surface of the splitter blade 260. The vortex generating structures 400 function to energize a boundary layer flow by promoting mixing of the air flowing over the splitter blade with the core flow, which encourages smooth flow over the splitter blade 260 and mitigates or prevents flow separation from the suction side 268 of the splitter blade 260.

In one embodiment, the vortex generating structures 400 may be considered micro vortex generators. The vortex generating structures 400 may have various types of individual and collective characteristics. In the embodiment of FIG. 4, the vortex generating structures 400 are arranged to generate a series of counter-rotating vortices 408.

The vortex generating structures 400 may have any suitable shape, and each structure 400 may further be considered to have a leading end 410, a trailing end 412, a length 414 along the surface of the splitter blade 260, and a height 416 from the surface of the splitter blade 260. In the embodiment of FIG. 4, the vane generating structures 400 may be trapezoidal such that the leading end 410 may be angled, e.g., increasing or rising in height 416 along the length 414 from the leading end 410 and plateauing in height to the trailing end 412. An angle of the leading end 410 from the surface of the suction side 268 may be considered the rise angle. As example, the rise angle may be approximately 10° to approximately 90° relative to the surface of the suction side 268. The terminus of trailing end 412 may extend perpendicularly relative to the surface of the splitter blade 260. However, any shape may be provided. For example, the vortex generating structures 400 may be triangular, square-shaped, or irregular.

In the embodiment of FIG. 4, the vortex generating structures 400 are arranged in pairs 402, e.g., with a first vortex generating structure 404 and a second vortex generating structure 406, and the pairs are arranged in a circumferential row. The count (or number) of the vortex generating structures 400 in the circumferential row may vary, for example, approximately 25 to approximately 1000. In one embodiment, the count is approximately 75 to approximately 250. Although a single row is depicted in FIG. 4, multiple rows may be provided.

In the embodiment of FIG. 4, each structure 404, 406 of a respective pair 402 may be angled relative to one another and relative to the flow direction. For example, structure 404 may be oriented at a first angle 420 relative to the flow direction, and structure 406 may be oriented at a second angle 422 relative to the flow direction. As examples, the first angle 420 is approximately 2° to approximately 30°. In one embodiment, the second angle 422 may be supplementary to one another, e.g., the angles 420, 422 sum to 180°. As such, in one embodiment, the second angle 422 may be approximately 150° to 178°. In other examples, the angles 420, 422 may be non-complementary. In general, the paired vortex generating structures 400 are non-parallel, e.g., with different first and second angles 420, 422. In the depicted embodiment, the first angle 420 may be less than 90° and the second angle 422 may be greater than 90° such that the paired vortex generating structures 400 are oriented such that the trailing ends 412 diverge or generally point away from one another (and the leading ends 410 point towards one another.

As noted above, the vortex generating structures 400 are paired and angled to produce counter-rotating vortices 408. In one embodiment, the counter-rotating vortices provide the desired energy characteristics to mix the air flowing along the suction side 268 with the core flow flowing through the duct. As angled, the vortex generating structures 400 may be considered to have a forward surface that at least partially faces the oncoming flow and an opposite aft surface. As shown, the vortices 408 may be most pronounced from the trailing ends 412 of the structures 400. In particular, the vortices 408 tend to result from air flow striking the forward surface, flowing along the forward surface, and curling around the trailing end 412 towards the aft surfaces. Since the paired vortex generating structures 400 have different orientations and are generally non-parallel, the resulting adjacent vortices 408 may be counter-rotating relative to one another.

Similarly, the structures 400 within a pair and relative to adjacent pairs may have any suitable spacing. In one embodiment, the structures 404, 406 may be spaced such that the leading ends 410 are separated by a gap distance 426. The gap distances 426 may be sized such that the vortices generated by the structures 404, 406 are appropriately positioned and have the desired characteristics. For example, the structures 404, 406 may have a length 414 and gap distances 426 such that vortices 408 at the trailing ends 412 of the array of vortex generating structures 400 are appropriately placed and sized. In one embodiment, the gap distances 426 may be approximately 2 mm to approximately 10 mm.

The length 414 and height 416 of the vortex generating structures 400 may also influence the vortex characteristics. In one embodiment, the length 414 may be approximately 10 mm to approximately 50 mm. In one embodiment, the height 416 may be approximately 1 mm to approximately 20 mm. In particular, the height 416 may be approximately 2 mm to approximately 5 mm.

Figure 5:
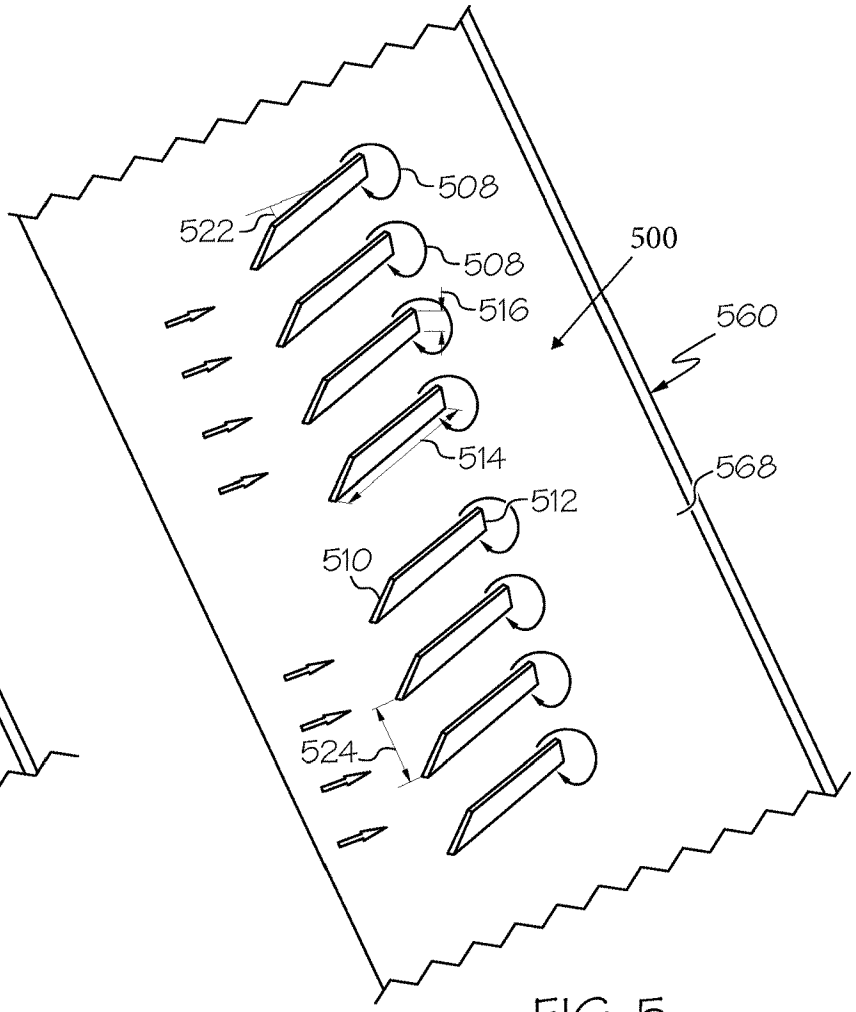
FIG. 5 is a schematic suction side view of a splitter blade in the inter-turbine duct in accordance with another exemplary embodiment.

FIG. 5 is a schematic isometric suction side view of a splitter blade 560 in accordance with an exemplary embodiment. Unless otherwise noted, the splitter blade 560 is similar to the splitter blade 260 discussed above, and the view of FIG. 5 is similar to the view of FIG. 4 from the underside of the splitter blade 560.

As shown in FIG. 5, one or more vortex generating structures 500 are arranged on a suction side 568 of the splitter blade 560 as flow control mechanisms. As above, the vortex generating structures 500 function to energize a boundary layer flow by promoting mixing of the air flowing over the splitter blade with the core flow, which encourages smooth flow over the splitter blade 560 and mitigates or prevents flow separation from the suction side 568 of the splitter blade 560.

The vortex generating structures 500 may have any suitable shape, and each structure 500 may further be considered to have a leading end 510, a trailing end 512, a length 514 along the surface of the splitter blade 560, and a height 516 from the surface of the splitter blade 560. In the embodiment of FIG. 5, the leading end 510 may be angled, e.g., increasing or rising in height 516 along the length from the leading end 510 and plateauing in height to the trailing end 512. The terminus of trailing end 512 may extend perpendicularly relative to the surface of the splitter blade 560. In the embodiment of FIG. 5, the vortex generating structures 500 are arranged in in a row, parallel to one another, at an angle 522 relative to airflow and separated from one another at a gap distance 524. Unless otherwise noted, the vortex generating structures 500 may have similar individual characteristics (e.g., length 514, height 516, rise angle, etc.) to those of the vortex generating structures 400 discussed above in reference to FIG. 4.

The vortex generating structures 500 are angled relative to air flow with an angle of attack 522 of approximately 2° to approximately 30°, although the angle may vary. In the embodiment of FIG. 5, the vortex generating structures 500 are parallel to one another such that the resulting vortices 508 rotate in the same generate direction, i.e., co-rotate relative to one another.

The separated or gap distance 524 between vortex generating structures 500 may also be sized to result in the desired vortex characteristics. In one embodiment, the gap distance 524 is approximately 5 mm to approximately 25 mm.

Figure 6:
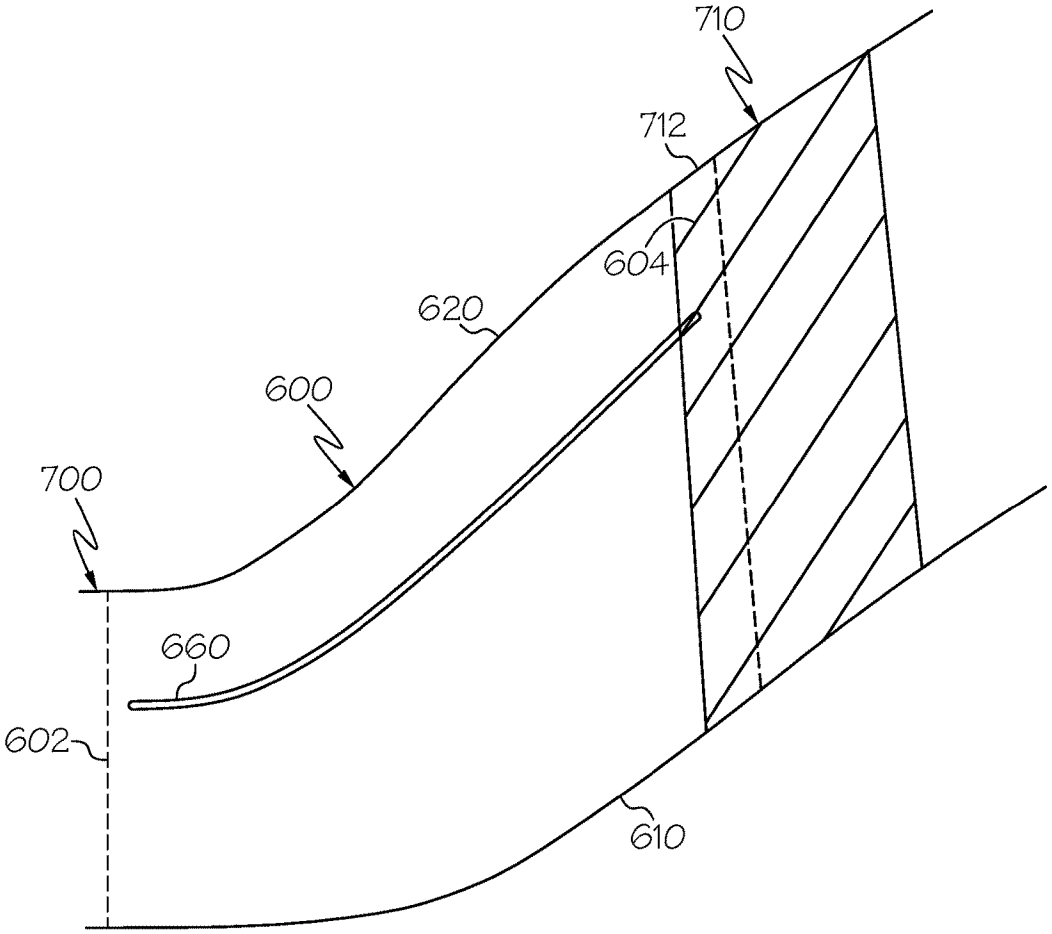
FIG. 6 is a schematic, partial cross-sectional view of a turbine section with an inter-turbine duct of a gas turbine engine in accordance with a further exemplary embodiment.

FIG. 6 is a schematic, partial cross-sectional view of a turbine assembly with an inter-turbine duct 600 that may be incorporated into a turbine section, such as the turbine section 150 of the engine 100 of FIG. 1 in accordance with another exemplary embodiment. Unless otherwise noted, the arrangement of the inter-turbine duct 600 is similar to the inter-turbine ducts 180 described above.

As above, the inter-turbine duct 600 extends between a high pressure turbine 700 and a low pressure turbine 710 and is defined by an inlet 602, an outlet 604, a hub 610, and a shroud 620. In this exemplary embodiment, at least one splitter blade 660 is provided within the inter-turbine duct 600 to prevent or mitigate the air flow separation and are positioned similar to the arrangement of FIG. 2.

In this embodiment, the splitter blade 660 extends proximate to or beyond the outlet 604 and are supported by a vane 712 of the low pressure turbine 710 that at least partially extends into the inter-turbine duct 600. As such, the splitter blade 660 may be considered to be integrated with the low pressure turbine vane 712. In such an embodiment, struts (e.g., struts 290 of FIG. 2) may be omitted, thereby enabling additional weight reductions. In some instances, this may also enable a shortening of the low pressure turbine 710 since all or a portion of the low pressure turbine vane 712 is incorporated into the inter-turbine duct 600.

Accordingly, the splitter blades 260, 560, 660 provide a combination of passive devices that maintain a smooth flow through the inter-turbine duct 180. In general, active devices, such as flow injectors, are not necessary.

In addition to the splitter blades, turbine sections, and inter-turbine ducts described above, exemplary embodiments may also be implanted as a method for controlling air flow through the inter-turbine duct of a turbine section. For example, the inter-turbine duct may be provided with radial characteristics (as well as other physical and operational characteristics) for overall engine design that should be accommodated. In response to the identification or potential of flow separation through the inter-turbine duct, a splitter blade may be provided. If testing or CFD analysis indicates that some flow separation still occurs, vortex generating structures may be provided on the suction side of the splitter blade. The characteristics and arrangements of the vortex generating structures may be modified, as described above, for the desired vortex characteristics and resulting impact on flow separation. In some embodiments, one or more additional splitter blade may be provided, each of which may or may not include vortex generating structures on the suction sides.

Accordingly, inter-turbine ducts are provided with splitter blades that prevent or mitigate boundary separation. The splitter blades are shaped and positioned to prevent or mitigate boundary separation along the shroud. The vortex generating structures function to prevent or mitigate boundary separation along the suction side of the splitter blade. In combination, the shape and position of the splitter blade and the vortex generating structures enable smooth flow through the overall inter-turbine duct, even for aggressive ducts. This is particularly applicable when the duct is too aggressive for a single splitter blade without vortex generating structures, but an additional splitter blade would be undesirable because of additional weight, complexity, cost, and surface area pressure losses. This enables an inter-turbine duct with only a single splitter blade.

By maintaining the energy of the boundary layer flowing through the duct, a more aggressively diverging duct can be used, allowing for the design of more compact, and also more efficient, turbines for engines. In particular, the radial angle of the inter-turbine duct may be increased and the axial length may be decreased to reduce the overall length and weight of the engine and to reduce friction and pressure losses in the turbine section. In one exemplary embodiment, the guide vanes may reduce pressure losses by more than 15%. Additionally, the splitter blades enable the use of a desired ratio between the radial sizes of the high pressure turbine and the low pressure turbine.

In general, the techniques described above can be applied either during the design of a new engine to take advantage of the shorter duct length and optimized area-ratio made possible by the boundary layer control, or to retrofit an existing engine or engine design in order to improve the efficiency of the engine while changing the design as little as possible. Although reference is made to the exemplary gas turbine engine depicted in FIG. 1, it is contemplated that the inter-turbine ducts discussed herein may be adapted for use with other types of turbine engines including, but not limited to steam turbines, turboshaft turbines, water turbines, and the like. Moreover, the turbine engine described above is a turbofan engine for an aircraft, although exemplary embodiments may include without limitation, power plants for ground vehicles such as locomotives or tanks, power-generation systems, or auxiliary power units on aircraft.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A turbine section of a gas turbine engine, the turbine section being annular about a longitudinal axis, the turbine section comprising:

a first turbine with a first inlet and a first outlet;

a second turbine with a second inlet and a second outlet;

an inter-turbine duct extending from the first outlet to the second inlet and configured to direct an air flow from the first turbine to the second turbine, the inter-turbine duct being defined by a hub and a shroud; and at least a first splitter blade disposed within the inter-turbine duct so as to be positioned between the hub and the shroud, the first splitter blade comprising a pressure side facing the shroud, a suction side facing the hub, and at least one vortex generating structure having a leading end opposite a trailing end positioned on the suction side that extends in a radial direction from a surface of the suction side toward the hub, the at least one vortex generating structure having a height that increases from the leading end to the trailing end.

2. The turbine section of claim 1, wherein the first splitter blade is the only splitter blade within the inter-turbine duct.

3. The turbine section of claim 1, wherein at least one vortex generating structure includes a plurality of the vortex generating structures arranged in a row.

4. The turbine section of claim 3, wherein each of the vortex generating structures are angled relative to a flow direction of the air flow through the inter-turbine duct.

5. The turbine section of claim 3, wherein each of the vortex generating structures is arranged parallel to one another.

6. The turbine section of claim 5, wherein the vortex generating structures are arranged such that co-rotating vortices are generated.

7. The turbine section of claim 3, wherein the vortex generating structures alternate with a first vortex generating structure arranged at a first angle relative to a flow direction of the air flow and a second vortex generating structure arranged at a second angle relative to the flow direction, the first angle being different than the second angle.

8. The turbine section of claim 7, wherein the vortex generating structures are arranged such that counter-rotating vortices are generated.

9. The turbine section of claim 1, wherein the at least one vortex generating structure is generally trapezoidal shaped.

10. The turbine section of claim 1, wherein the first splitter blade extends in axial-circumferential planes about the longitudinal axis.

11. The turbine section of claim 1, wherein the first splitter blade is generally parallel to a respective mean line curve.

12. The turbine section of claim 1, wherein the first splitter blade and the at least one vortex generating structure are passive flow control devices.

13. The turbine section of claim 1, wherein the first turbine is a high pressure turbine and the second turbine is a low pressure turbine.

14. An inter-turbine duct extending between a first turbine having a first radial diameter and a second turbine having a second radial diameter, the first radial diameter being less than the second radial diameter, the inter-turbine duct comprising:

a hub;

a shroud circumscribing the hub to form a flow path fluidly coupled to the first turbine and the second turbine; and at least a first splitter blade disposed within the inter-turbine duct so as to be positioned between the hub and the shroud, the first splitter blade comprising a pressure side facing the shroud, a suction side facing the hub, and at least one vortex generating structure having a leading end opposite a trailing end positioned on the suction side that extends in a radial direction from the suction side toward the hub, the at least one vortex generating structure having a height that increases from the leading end to the trailing end.

15. The inter-turbine duct of claim 14, wherein at least one vortex generating structure includes a plurality of the vortex generating structures arranged in a row.

16. The inter-turbine duct of claim 15, wherein each of the vortex generating structures are angled relative to a flow direction of the air flow through the inter-turbine duct.

17. The inter-turbine duct of claim 15, wherein each of the vortex generating structures is arranged parallel to one another, and wherein the vortex generating structures are arranged such that co-rotating vortices are generated.

18. The inter-turbine duct of claim 15, wherein the vortex generating structures alternate with a first vortex generating structure arranged at a first angle relative to a flow direction of the air flow and a second vortex generating structure arranged at a second angle relative to the flow direction, the first angle being different than the second angle, and wherein the vortex generating structures are arranged such that counter-rotating vortices are generated.

19. The inter-turbine duct of claim 14, wherein the at least one vortex generating structure is generally trapezoidal shaped.

20. The inter-turbine duct of claim 14, wherein the first splitter blade and the at least one vortex generating structure are passive flow control devices.

* * * * *